US009983521B2

(12) United States Patent
Miyata et al.

(10) Patent No.: US 9,983,521 B2
(45) Date of Patent: May 29, 2018

(54) FIXING DEVICE AND IMAGE FORMING APPARATUS

(71) Applicant: FUJI XEROX CO., LTD., Tokyo (JP)

(72) Inventors: Toshiyuki Miyata, Kanagawa (JP); Takahito Chiba, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days. days.

(21) Appl. No.: 15/434,420

(22) Filed: Feb. 16, 2017

(65) Prior Publication Data

US 2018/0074443 A1 Mar. 15, 2018

(30) Foreign Application Priority Data

Sep. 15, 2016 (JP) ..... 2016-180427

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2014/0314456 A1* 10/2014 Kikuchi ..... G03G 15/2042 399/329

FOREIGN PATENT DOCUMENTS

JP 2008-152247 A 7/2008
JP 4261727 B2 4/2009

* cited by examiner

*Primary Examiner* — Sandra Brase
(74) *Attorney, Agent, or Firm* — Sughrue Mion, PLLC

(57) ABSTRACT

Provided is a fixing device including a belt that generates heat by an action of a magnetic field to fix an image to a medium by the heat, a magnetic field generating unit that generates a magnetic field which heats the belt, a heat generation control member that includes a first magnetic body which is changed from ferromagnetism to paramagnetism at a Curie temperature, and suppresses heat generation of the belt, a sensor that is disposed in a first space, measures a temperature of an object present on the belt side, and is heated by an action of a magnetic field, and a second magnetic body that is disposed in a second space.

19 Claims, 18 Drawing Sheets

731S2
731
MAGNETIC BODY
TEMPERATU-
RE SENSOR
MAGNETIC BODY
S1
A6

735
735
MAGNETIC BODY
TEMPERATU-
RE SENSOR
MAGNETIC BODY
S2

731
MAGNETIC BODY
TEMPERATU-
RE SENSOR
MAGNETIC BODY
75
S3
A6

731
MAGNETIC BODY
TEMPERATU-
RE SENSOR
MAGNETIC BODY
75
S4
S4

A6

A6

FIXING DEVICE AND IMAGE FORMING APPARATUS

CROSS-REFERENCE TO RELATED APPLICATIONS

This application is based on and claims priority under 35 USC 119 from Japanese Patent Application No. 2016-180427 filed Sep. 15, 2016.

BACKGROUND

Technical Field

The present invention relates to a fixing device and an image forming apparatus.

SUMMARY

According to an aspect of the invention, there is provided a fixing device including:

a belt that generates heat by an action of a magnetic field to fix an image to a medium by the heat;

a magnetic field generating unit that is disposed on a first surface side of the belt to generate a magnetic field that heats the belt;

a heat generation control member that includes a first magnetic body that is disposed in a space on a second surface side of the belt and is changed from ferromagnetism to paramagnetism at a Curie temperature, the heat generation control member suppressing heat generation of the belt;

a sensor that is disposed in a first space, which is obtained by excluding a space, which is closer to the belt with respect to the first magnetic body and is present in a thickness direction of the belt when viewed from the first magnetic body, from the space on the second surface side, the sensor measuring a temperature of an object that is present on the belt side and heated by an action of a magnetic field; and a second magnetic body that is disposed in a second space, which is obtained by excluding a space, which is opposite to the belt with respect to the sensor and is present in the thickness direction when viewed from the sensor, from the space on the second surface side.

BRIEF DESCRIPTION OF THE DRAWINGS

Exemplary embodiments of the present invention will be described in detail based on the following figures, wherein.

DETAILED DESCRIPTION

[1] Exemplary Embodiment

Figure 1:
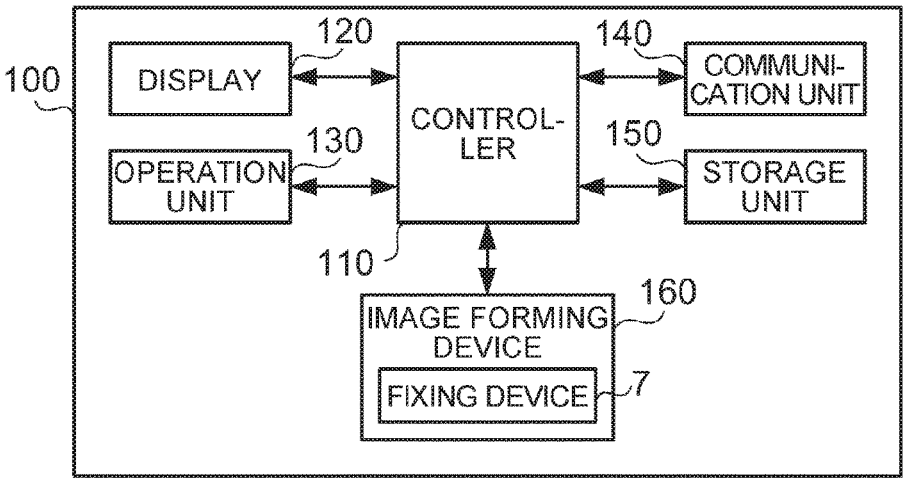
FIG. 1 is a view illustrating an overall configuration of an image forming apparatus according to an exemplary embodiment.

FIG. 1 illustrates an overall configuration of an image forming apparatus 100 according to an exemplary embodiment. The image forming apparatus 100 is an apparatus that forms an image based on image data. The image forming apparatus 100 includes a controller 110, a display 120, an operation unit 130, a communication unit 140, a storage unit 150, and an image forming device 160.

The controller 110 is a computer that is provided with an arithmetic operation device including a central processing unit (CPU) or a memory. The arithmetic operation device of the controller 110 executes a program stored in the memory to control each unit of the image forming apparatus 100 or to process data. In addition, the controller 110 has a function of measuring a time so as to acquire the time when these controls or processings are performed, or to perform these controls or processings at a predetermined time. The display 120 includes a liquid crystal display screen and a liquid crystal drive circuit, and displays the progress state of a processing or information for providing an operation guide to a user based on information supplied from the controller 110.

The operation unit 130 includes an operation element (e.g., a button), and supplies operating information, which indicates operation contents based on a user's operation, to the controller 110. The communication unit 140 is connected to a communication line, such as, for example, local area network (LAN), and communicates with an external device connected to the communication line. Transmitted from the external device are, for example, image data for forming an image and request data indicating that it is requested to form the image on sheet. The communication unit 140 supplies these transmitted data to the controller 110. The storage unit 150 includes a storage device, such as a hard disc drive (HDD), and stores, for example, the image data. The image forming device 160 forms an image on a medium (recording medium), such as, for example, sheet, via an electrophotographic system using toners of four colors of yellow (Y), magenta (M), cyan (C), and black (K).

Figure 2:
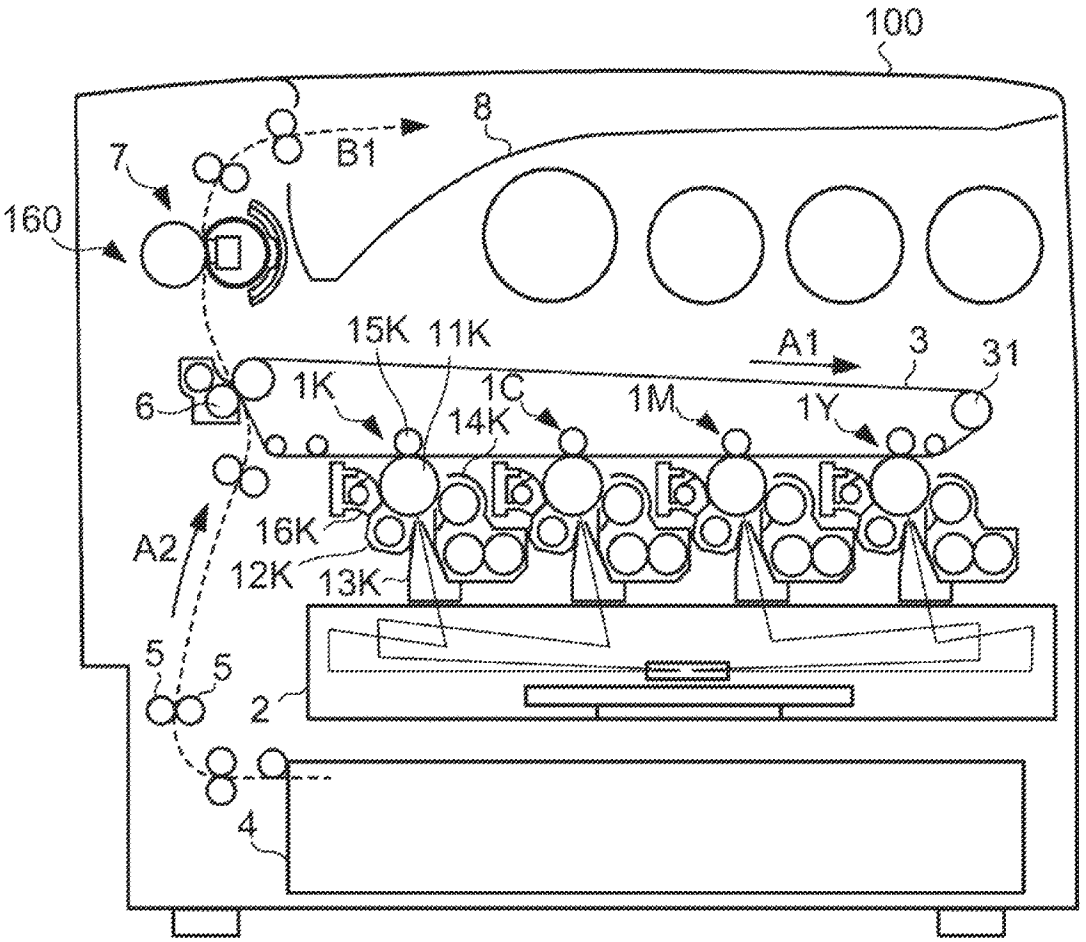
FIG. 2 is a view illustrating a configuration of an image forming device.

FIG. 2 illustrates a configuration of the image forming device 160. In each reference numeral of the image forming device 160 illustrated in FIG. 2, an alphabet attached to the end thereof corresponds to the color of the toner handled by the image forming apparatus. Constituent elements, of which alphabets at the end of the reference numeral are different, are common to each other although the colors of the toners to be handled thereby are different from each other. In the following description, when it is not necessary to particularly distinguish these respective constituent elements from each other, the alphabets at the end of the reference numeral will be omitted and descriptions will be made thereon. The image forming device 160 includes image forming units 1Y, 1M, 1C and 1K, an exposure device 2, an intermediate transfer belt 3, a sheet feeding unit 4, plural transport rollers 5, a secondary transfer roller 6, a fixing device 7, and a discharge unit 8.

The exposure device 2 outputs a light (exposure light) depending on image data of each color to each of the image forming units 1, so that each image forming unit 1 forms an electrostatic latent image, which becomes the source of an image of each color. The image forming units 1Y, 1M, 1C, and 1K develop the electrostatic latent images using the toners to form images of respective colors, respectively. As to a configuration of the image forming units 1, the configuration of the image forming unit 1K will be described by way of an example. The image forming unit 1K includes a photoconductor 11K, a charging device 12K, an exposure unit 13K, a developing device 14K, a primary transfer roller 15K, and a cleaning device 16K. The photoconductor 11K is a cylindrical member, which has a photoconductive film laminated on the surface thereof and rotates about an axis. The photoconductor 11K holds an electrostatic latent image formed on the surface thereof.

The charging device 12K charges the photoconductor 11K with a predetermined charging potential. The exposure unit 13K forms a path, along which the exposure light output from the exposure device 2 reaches the photoconductor 11K. On the surface of the photoconductor 11K charged by the charging device 12K, the exposure light output from the exposure device 2 reaches through the exposure unit 13K, and an electrostatic latent image is formed according to image data. The developing device 14K accommodates a developer having a toner that is a non-magnetic body and a carrier that is a magnetic body. The developing device 14K supplies the toner included in the developer to the electrostatic latent image, and develops the electrostatic latent image to form an image on the surface of the photoconductor 11K. The primary transfer roller 15K primarily transfers the image from the photoconductor 11K to the intermediate transfer belt 3. The cleaning device 16K removes the toner remaining on the surface of the photoconductor 11K after the primary transfer is performed.

The intermediate transfer belt 3 extends over plural rollers including a driving roller 31, and is rotatably supported by the rollers. The driving roller 31 is driven by a driving mechanism (not illustrated), which is controlled by the controller 110, and rotates at a rotational speed (rotating speed) determined by the controller 110. The intermediate transfer belt 3 rotates in the rotational direction A1 indicated by the arrow as the driving roller 31 rotates. To the outer circumferential surface of the intermediate transfer belt 3, images formed by the respective image forming units are primarily transferred to overlap with each other. In the sheet feeding unit 4, plural sheets are accommodated.

The plural transport rollers 5 are transport units that form a transport path B1 indicated by the dashed arrow, which extends from the sheet feeding unit 4 to the discharge unit 8 via the secondary transfer roller 6 and the fixing device 7, and transport a sheet along the transport path B1 in the transport direction A2 indicated by the arrow. The transport rollers 5 are driven by a driving mechanism (not illustrated), which is controlled by the controller 110, and rotates at a rotational speed determined by the controller 110.

The secondary transfer roller 6 comes into contact with the intermediate transfer belt 3 to form a transfer region that is a region for the transfer of an image. The secondary transfer roller 6 secondarily transfers the image, which has been primarily transferred to the intermediate transfer belt 3, on the sheet transported to the transfer region by the plural transport rollers 5. With this secondary transfer of the image, the image is formed on the sheet. The secondary transfer roller 6 is driven by a driving mechanism (not illustrated), which is controlled by the controller 110, and rotates at a rotational speed determined by the controller 110. The sheet that has passed through the transfer region is transported to the fixing device 7 along the transport path B1.

The fixing device 7 fixes the image, which has been secondarily transferred to the transported sheet, to the sheet by applying heat and pressure to the image. The fixing device 7 is controlled by the controller 110 illustrated in FIG. 1 with respect to, for example, the timing at which such heating is performed. The fixing device 7 and the controller 110 cooperate with each other so as to function as a "fixing device" according to the present invention. The sheet having the image formed thereon is transported by the plural transport rollers 5 to be discharged to the discharge unit 8. The image forming unit 1, the exposure device 2, the intermediate transfer belt 3, and the secondary transfer roller 6 described above are units that form an image on a medium, such as, for example, a sheet, and correspond to an example of "image forming device" according to the present invention. The image formed on the medium by the image forming device is fixed to the medium by the fixing device 7.

Figure 3:
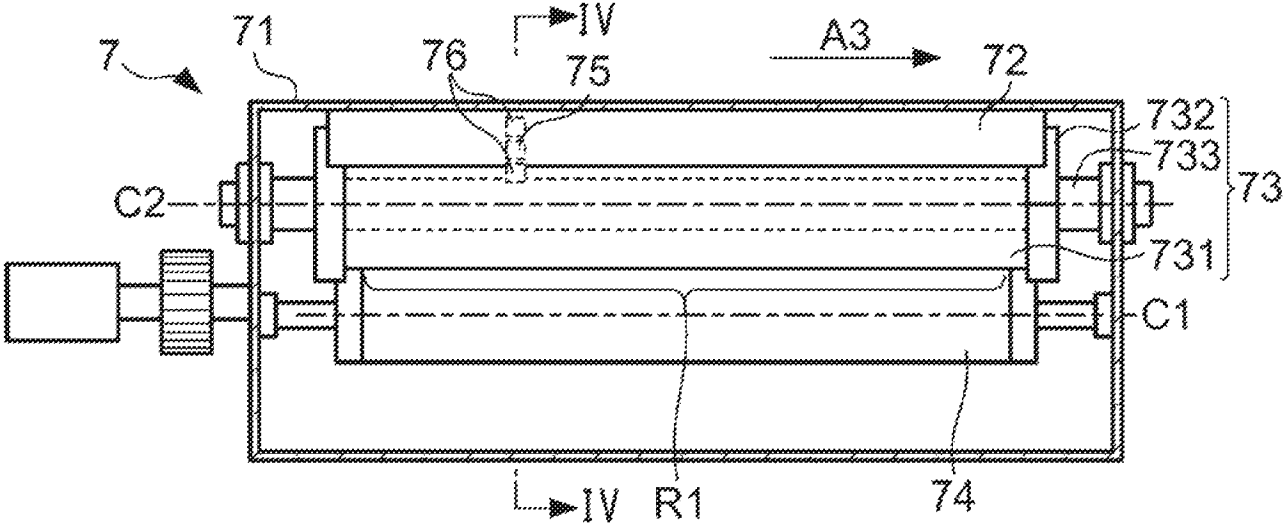
FIG. 3 is a view illustrating a fixing device viewed in a transport direction.

FIG. 3 illustrates the fixing device 7 when viewed in the transport direction A2. FIG. 3 illustrates the fixing device 7 when viewed from the sheet carry-in side. The fixing device 7 includes a support body 71, and an induction heating (IH) heater 72, a fixing member 73, a pressurizing roller 74, a temperature sensor 75, and two magnetic bodies 76, which are provided inside the support body 71. The pressurizing roller 74 is a roller that rotates about an axis C1 indicated by the dash-dotted arrow and is rotatably supported by the support body 71. The axis C1 extends in the axial direction A3 indicated by the arrow.

The pressurizing roller 74 is brought into contact with or separated from the fixing member 73 by a connection/separation mechanism (not illustrated). FIG. 3 illustrates the state where the pressurizing roller 74 is in contact with the fixing member 73. In this state, the fixing member 73 and the pressurizing roller 74 form a nip region R1. The nip region R1 is a region through which a sheet passes. The fixing member 73 is a member that fixes an image on the sheet in the nip region R1. The fixing member 73 includes a fixing belt 731, a belt support member 732, and a holder 733.

The fixing belt 731 is an endless belt formed in a cylindrical shape, and is a member that brings the outer circumferential surface thereof into contact with the pressurizing roller 74 to form the nip region R1. The fixing belt 731 generates heat by electromagnetic induction that is caused by an alternating current magnetic field generated by the IH heater 72. The fixing belt 731 fixes an image on a medium by the heat generated by the action of the magnetic field. The fixing belt 731 is one example of a "belt" of the present invention.

The fixing belt 731 includes, for example, a base material, a heating layer formed on the outer circumferential surface thereof, and a surface release layer. The base material is made from a material that has strength to support the heating layer and heat resistant, and does not generate heat or hardly generates heat by the action of a magnetic field while passing through the magnetic field (magnetic flux). The material of the base material is, for example, a metal belt (i.e., a belt made of a metal material, such as, a non-magnetic metal (e.g., a non-magnetic stainless steel) or a soft metal material or a hard metal material (e.g., Fe, Ni, Co, or an alloy thereof (e.g., an Fe—Ni—Co or Fe—Cr—Co alloy))) having a thickness of 30 μm or more and 200 μm or less (preferably, 50 μm or more and 150 μm or less, and more preferably, 100 μm or more and 150 μm or less), or a resin belt (e.g., a polyimide belt) having a thickness of 60 μm or more and 200 μm or less.

The heating layer is made from a material, which easily penetrates a magnetic field (magnetic flux) and easily generates heat by the action of a magnetic field. It is desirable that the heat capacity of the heating layer is as small as possible. When the heating layer is formed as thin as 50 μm or less using a general-purpose power supply having a frequency of 20 kHz to 100 kHz (when the general-purpose power supply is used, low-cost manufacture is possible), non-magnetic metals having low resistivity are more easily heated than magnetic metals by electromagnetic induction. On the contrary, when the thickness of the heat generation layer is larger than 50 μm, magnetic metals easily generate heat. In general, because magnetic metals have high resistivity and the relative permeability of the magnetic metals is several tens to several thousands, an eddy current hardly flows in a skin depth. For example, as magnetic metals, iron has resistivity of $9.71\times10^{-8}$ Ωm and nickel has resistivity of $6.84\times10^{-8}$ Ωm.

Meanwhile, as non-magnetic metals having low resistivity, silver, copper, and aluminum have a low resistivity of $1.59\times10^{-8}$ Ωm, $1.67\times10^{-8}$ Ωm, and $2.7\times10^{-3}$ Ωm, respectively, and have relative permeability of approximately 1. Thus, the non-magnetic metals easily generate heat when they are thin. In particular, the non-magnetic metals easily generate heat when the thickness thereof is 20 μm or less. On the contrary, the non-magnetic metals hardly generate heat when the thickness thereof is larger than 20 μm, and the calorific value generated due to the loss of the eddy current is reduced because the non-magnetic metals have low resistivity even though an eddy current flows therethrough. The heating layer is made from, for example, a non-magnetic metal material, of which the thickness is 2 μm or more and 20 μm or less (preferably, 5 μm or more and 15 μm or less and the total heat capacity of a heat generation region of, for example, 3 J/K or less). As the non-magnetic metal material, copper, aluminum, or silver is preferable as described above.

The surface release layer is, for example, a fluororesin layer (e.g., a tetrafluoroethylene/perfluoroalkyl vinyl ether copolymer (PFA) layer) having a thickness of 1 μm or more and 30 μm or less. In addition, the fixing belt 731 is not limited to the configuration described above, and may be a belt in which a heating layer is sandwiched between two base materials. Specifically, the fixing belt 731 may be, for example, a belt in which a heating layer (e.g., a copper layer) is sandwiched between two stainless steel base materials.

In addition, an elastic layer, which includes, silicone rubber, fluoro rubber, or fluorosilicone rubber, may be formed and sandwiched between the base material and the heating layer or between the heating layer and the surface release layer. In any case, it is desirable that the heat capacity of the fixing belt 731 is as small as possible (e.g., the heat capacity of 5 J/K or more and 60 J/K or less, and preferably, 30 J/K or less). In addition, on the inner circumferential surface of the fixing belt 731, a film coated with a fluoride resin, which is durable against sliding, may be formed, a fluororesin or the like may be coated, or a lubricant (e.g., silicone oil) may be applied.

The IH heater 72 generates an alternating current magnetic field in a space including the fixing member 73 when power is supplied thereto. More specifically, the IH heater 72 is disposed on one surface side of the fixing belt 731 to generate a magnetic field for heating the fixing belt 731. Of the two surfaces of the fixing belt 731, hereinafter, one surface on which the IH heater 72 is disposed will be referred to as a "first surface 731S1", and the opposite surface will be referred to as a "second surface 731S2." The IH heater 72 is an example of a "magnetic field generating unit" of the present invention. When the fixing belt 731 is heated by the magnetic field generated by the IH heater 72, the fixing belt 731 applies heat to a sheet passing through the nip region R1, and fixes an image formed on the sheet. The holder 733 is a bar-shaped member, which extends in the axial direction A3, and opposite ends of the holder in the axial direction A3 are anchored to the support body 71.

The belt support member 732 is a member that supports opposite end portions of the fixing belt 731 in the axial direction A3 while maintaining the cross section of the fixing belt 731 in a circular shape. The belt support member 732 is supported on the holder 733 in the state where the belt support member 732 is rotatable about the axis of the fixing belt 731, and rotates in the circumferential direction of the fixing belt 731 by a driving mechanism (not illustrated). Thus, the fixing belt 731 rotates about an axis C2 indicated by the dash-dotted arrow. The axis C2 also extends in the axial direction A3, like the axis C1.

Figure 4:
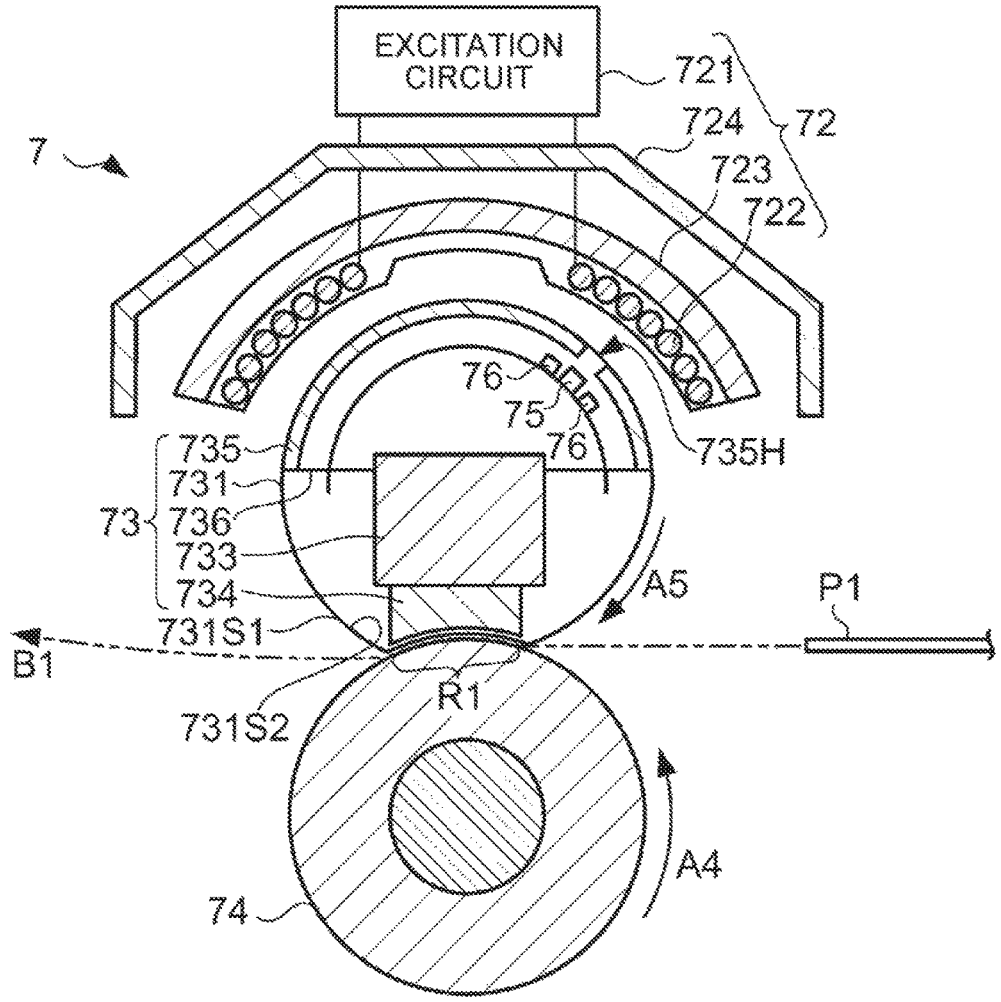
FIG. 4 is a view illustrating the cross section of the fixing device viewed in the direction indicated by the arrows IV-IV in FIG. 3.

FIG. 4 illustrates a cross section of the fixing device 7 viewed in the direction indicated by the arrows IV-IV in FIG. 3. In FIG. 4, the support body 71 is omitted. The IH heater 72 includes an excitation circuit 721, an excitation coil 722, a magnetic core 723, and a shield 724. The excitation circuit 721 supplies an alternating current of a predetermined frequency to the excitation coil 722. The frequency is, for example, the frequency of alternating current generated by a general-purpose power supply, and is for example, 20 kHz or more and 100 kHz or less. The current amount of the alternating current is controlled by the controller 110.

The excitation coil 722 is a coil formed by winding a litz wire, which is formed by bundling mutually insulated copper wire rods, in a hollow closed loop shape, such as, an elliptical shape or a rectangular shape. When the alternating current is supplied from the excitation circuit 721 to the excitation coil 722, an alternating current magnetic field centered on the litz wire is generated around the excitation coil 722. As the current amount is increased, the intensity of the alternating current magnetic field to be generated is increased.

The magnetic core 723 is, for example, an arc-shaped ferromagnetic body that is made from a material, such as, sintered ferrite, ferrite resin, Permalloy, or thermal-sensitive magnetic alloy. These materials are oxides or alloys having a relatively high magnetic permeability. The magnetic core 723 inwardly induces magnetic force lines (magnetic fluxes) of the alternating current magnetic field generated around the excitation coil 722, and forms a passage of magnetic force lines (a magnetic path), which penetrates the fixing member 73 from the magnetic core 723 and returns to the magnetic core 723 from a heat generation control member 735 having a temperature-sensitive magnetic material. When the magnetic path is formed between the magnetic core 723 and the temperature-sensitive magnetic material of the heat generation control member 735, the magnetic force lines of the alternating current magnetic field are concentrated on the portion of the fixing member 73 that faces the magnetic core 723, and form the magnetic field of a high magnetic flux density, thereby realizing high efficient induction heating. The shield 724 shields the magnetic field to suppress the outward leakage of the magnetic field.

As described above, the fixing belt 731 comes into contact with the pressurizing roller 74 to form the nip region R1. To the nip region R1, a sheet P1 is transported along the transport path B1 by the plural transport rollers 5 illustrated in FIG. 2. The plural transport rollers 5 are units that transport the sheet having an image formed thereon to the nip region R1. The pressurizing roller 74 rotates in the rotational direction A4 indicated by the arrow, and the fixing belt 731 rotates in the rotational direction A5 indicated by the arrow. When the pressurizing roller 74 and the fixing belt 731 rotate in these directions, the sheet P1 transported to the nip region R1 passes through the nip region and is again transported along the transport path B1.

The fixing member 73 includes a pad 734, the heat generation control member 735, and a support member 736, in addition to the fixing belt 731 and the holder 733 described above. The pad 734 is made from a material that is deformed by pressure, such as silicone rubber or fluororubber, and is located inside the fixing belt 731 at the position opposite to the pressurizing roller 74. The pad 734 supports the fixing belt 731, which is pressed from the pressurizing roller 74, in the nip region R1. The holder 733 is formed using, for example, a heat-resistant resin, such as, glass mixed polyphenylene sulfide (PPS), or a non-magnetic metal, such as, Au, Ag, or Cu. Thus, the holder 733 is relatively hardly affect the induced magnetic field compared to the case where other materials are used, and is also hardly affected by the induced magnetic field.

The heat generation control member 735 includes a temperature-sensitive magnetic material, which is disposed in a space on the second surface 731S2 side of the fixing belt 731 and changes from ferromagnetism to paramagnetism at the Curie temperature. The heat generation control member 735 suppresses the heat generation of the fixing belt 731. The temperature-sensitive magnetic material is one example of a "first magnetic body" of the present invention. The heat generation control member 735 is configured in a shape that imitates the second surface 731S2 of the fixing belt 731. The heat generation control member 735 comes into contact with the second surface 731S2 of the fixing belt 731 and is disposed to be opposite to the IH heater 72 via the fixing belt 731.

The heat generation control member 735 is supported, by the support member 736, to come into contact with the second surface 731S2 of the fixing belt 731 in a non-pressed state while maintaining the fixing belt 731 in a cylindrical shape. Because no tension is applied to the fixing belt 731, the shape of the fixing belt 731 is not excessively changed even though the heat generation control member 735 comes into contact with the fixing belt 731. The support member 736 includes spring members on the opposite ends thereof (the opposite ends of the heat generation control member 735 in the axial direction A3).

The spring members are, for example, curved leaf springs (leaf springs made of, for example, metals and various elastomers) and are connected to the heat generation control member 735. By the spring members, the heat generation control member 735 is supported, and even if the fixing belt 731 is eccentrically rotated and is displaced in a radial direction, the heat generation control member 735 follows the displacement, and remains in contact with the second surface 731S2 of the fixing belt 731. In addition, the heat generation control member 735 may include the spring members.

A material used for the temperature-sensitive magnetic material of the heat generation control member 735 has the Curie temperature that is equal to or higher than the set temperature of the fixing belt 731 and is equal to or lower than the heat-resistant temperature of the fixing belt 731. Specifically, the Curie temperature of the temperature-sensitive magnetic material is preferably 140° C. or more and 240° C. or less, and more preferably 150° C. or more and 230° C. or less.

The heat generation control member 735 itself may be a non-heating element that does not generate heat by the action of a magnetic field. This is because when a non-heating element generates heat of a predetermined temperature or more, a magnetic flux due to electromagnetic induction acts on the non-heating element when the fixing belt 731 is heated via electromagnetic induction action on the heating layer, and thus there is a case in which the temperature of the non-heat generation element may be increased and unintentionally reach the Curie temperature when self-heating due to an eddy current loss or hysteresis loss is large, and the non-heating element may exhibit a temperature suppressing effect when it is not necessary.

Because the non-heating element is a member that is necessary to suppress the temperature of the fixing belt 731, an unintentional temperature increase due to self-heating needs to be reduced as much as possible. The non-heating element of the present exemplary embodiment is a member of which the self-heating is a predetermined ratio or less relative to the heat generation of the heating layer, and may have a slit or notch that causes an eddy current loss to hardly occur when a problem arises in exhibiting a function due to self-heating. The slit or notch functions as a blocking unit that prevents an eddy current from being generated in the heat generation control member 735 by an electromagnetic induction action from the IH heater 72.

In addition, the temperature-sensitive magnetic material is generally classified into a metal material and an oxide material. The oxide material (e.g., ferrite) is hardly reduced in thickness (to 300 μm or less) and easily cracks so that the oxide material is difficult to handle. Further, due to the increased heat capacity and low thermal conductivity, the oxide material may not sensitively follow a variation in the temperature of the fixing belt so that an aimed heat generation control may not be performed. To address these problems, a metal material, such as a magnetic shunt steel of non-crystalline alloy or an amorphous alloy, which is inexpensive and easily moldable into a thin thickness, and has good workability, flexibility, and high thermal conductivity, is used.

That is, as metal alloy materials including, for example, Fe, Ni, Si, B, Nb, Cu, Zr, Co, Cr, V, Mn, and Mo, for example, a Fe—Ni binary system magnetic shunt steel or Fe—Ni—Cr ternary system magnetic shunt steel may be used. The temperature-sensitive magnetic material exhibits ferromagnetism in the state where it is below the Curie temperature, and is demagnetized when it reaches the Curie temperature. When a ferromagnetic body having a relative magnetic permeability of at least several hundreds or more is demagnetized (paramagnetized), the relative magnetic permeability approaches 1 and a variation in magnetic flux density (the strength of a magnetic field) occurs. Therefore, through demagnetization, the magnetic flux density may be reduced and the material may be changed to hardly generate heat.

In addition, the skip depth of a conductor material including a metal is determined by Equation (1) when δ is the skin depth (m), ρ is the resistivity value (Ωm), f is the frequency (Hz), and $\mu_r$ is relative permeability.

$$\delta = 503\sqrt{\frac{\rho}{f \times \mu_r}} \quad \text{Equation (1)}$$

When the skin depth is equal to or smaller than the thickness of a temperature-sensitive magnetic metal layer, this may be realized by increasing the magnetic permeability of a material by a heat treatment, increasing the frequency of the IH heater 72, or selecting a material having a low resistivity value. In the present exemplary embodiment, although it may not be necessary for the skin depth to be equal to or smaller than the thickness of the temperature-sensitive magnetic metal layer, the skin depth, which is equal to or smaller than the thickness of the temperature-sensitive magnetic metal layer, may be preferable in terms of improving effects. In this case, the specific magnetic permeability of the temperature-sensitive magnetic material is selected according to Equation (1) based on at least the thickness of the heat generation control member 735 when the temperature is below the Curie temperature.

For example, when the temperature-sensitive magnetic material is an Fe—Ni system magnetic shunt alloy and the thickness of the heat generation control member 735 is 50 μm, the specific magnetic permeability is set to be at least 5,000 or more. The heat generation control member 735 may have a predetermined thickness (e.g., 20 μm or more and 300 μm or less), and may have, for example, a shape obtained by cutting a portion of a cylinder corresponding to a specific central angle (e.g., within a range from 300 or more to 1800 or less), without being limited thereto.

When the fixing device 7 fixes an image to a medium, the output of the IH heater 72 is, for example, within a range in which a magnetic flux (magnetic field) causes heat generation while penetrating the heating layer of the fixing belt 731 and in which the magnetic flux (magnetic field) hardly passes through the heat generation control member 735 and causes no heat generation at the temperature below the Curie temperature. When an image is successively fixed to a recording sheet P of a small size, which is smaller than a fixing region width (axial length) of the fixing belt 731, heat is consumed in a sheet passing portion of the fixing belt 731, whereas heat is not consumed in a non-sheet passing portion. Therefore, the temperature is increased in the non-sheet passing portion of the fixing belt 731.

In addition, when the temperature of the non-sheet passing portion of the fixing belt 731 reaches the Curie temperature of the temperature-sensitive magnetic material configuring the heat generation control member 735, a region of the heat generation control member 735 that overlaps (in contact) with the non-sheet passing portion of the fixing belt 731 is demagnetized. Thus, a difference in magnetic flux density (the strength of a magnetic field) occurs between a sheet passing region, which is the region where magnetism is maintained, and a non-sheet passing region, which is demagnetized (paramagnetized), and the heat generation of the heating layer in the non-sheet passing region becomes smaller than that in the sheet passing region. In this way, the heat generation of the heating layer of the fixing belt 731 is controlled by the heat generation control member 735. In addition, when the heat generation control member 735 is demagnetized (the specific magnetic permeability thereof approaches 1), the magnetic fluxes (magnetic field) easily penetrate the heat generation control member 735, as is seen from Equation (1).

The heat generation control member 735 has a hole 735H, which penetrates the fixing belt 731 in the thickness direction A6. The temperature sensor 75 is supported by the support member 736, and is disposed in the thickness direction A6 of the hole 735H. Therefore, the fixing belt 731 is directly visible through the hole 735H from the temperature sensor 75, and the temperature sensor 75 directly measures the temperature of the fixing belt 731. The temperature sensor 75 is a sensor that measures the temperature of an object present on the fixing belt 731 side, and in the present exemplary embodiment, measures the temperature of the fixing belt 731. The temperature sensor 75 is one example of a "sensor" of the present invention.

The temperature sensor 75 is disposed in a space opposite to the sheet passing portion in order to measure the temperature of the sheet passing portion of the fixing belt 731, through which a sheet passes. The temperature sensor 75 notifies the controller 110 illustrated in FIG. 1 of the measured temperature. When the controller 110 is notified of a predetermined upper limit temperature, the controller 110 determines that the temperature of the fixing belt 731 is excessively increased and thus performs a control to stop heating by the IH heater 72. For example, a temperature at which deformation or melting of the fixing belt 731 occurs is determined as the upper limit temperature. In addition, the temperature sensor 75 includes a conductor, and is heated by the action of a magnetic field (e.g., a magnetic field generated by the IH heater 72).

Both of the two magnetic bodies 76 are provided around the temperature sensor 75, and suppress the temperature increase of the temperature sensor 75 due to a magnetic field generated by the IH heater 72. In the present exemplary embodiment, as illustrated in FIG. 3, both of the two magnetic bodies 76 are provided close to the temperature sensor 75 in the direction orthogonal to the axial direction A3. The magnetic bodies 76 exhibit ferromagnetism at the temperature that is equal to or lower than the upper limit temperature of the fixing belt 731 described above, and attract the magnetic fluxes of a magnetic field generated by the IH heater 72, thereby reducing the magnetic fluxes passing through the temperature sensor 75 and suppressing the temperature increase of the temperature sensor 75, compared to the case where the magnetic bodies 76 are not provided.

The arrangement of the temperature sensor 75 and the magnetic bodies 76 and the principle of suppressing the temperature increase will be described below in more detail with reference to FIGS. 5 to 9.

Figure 5:
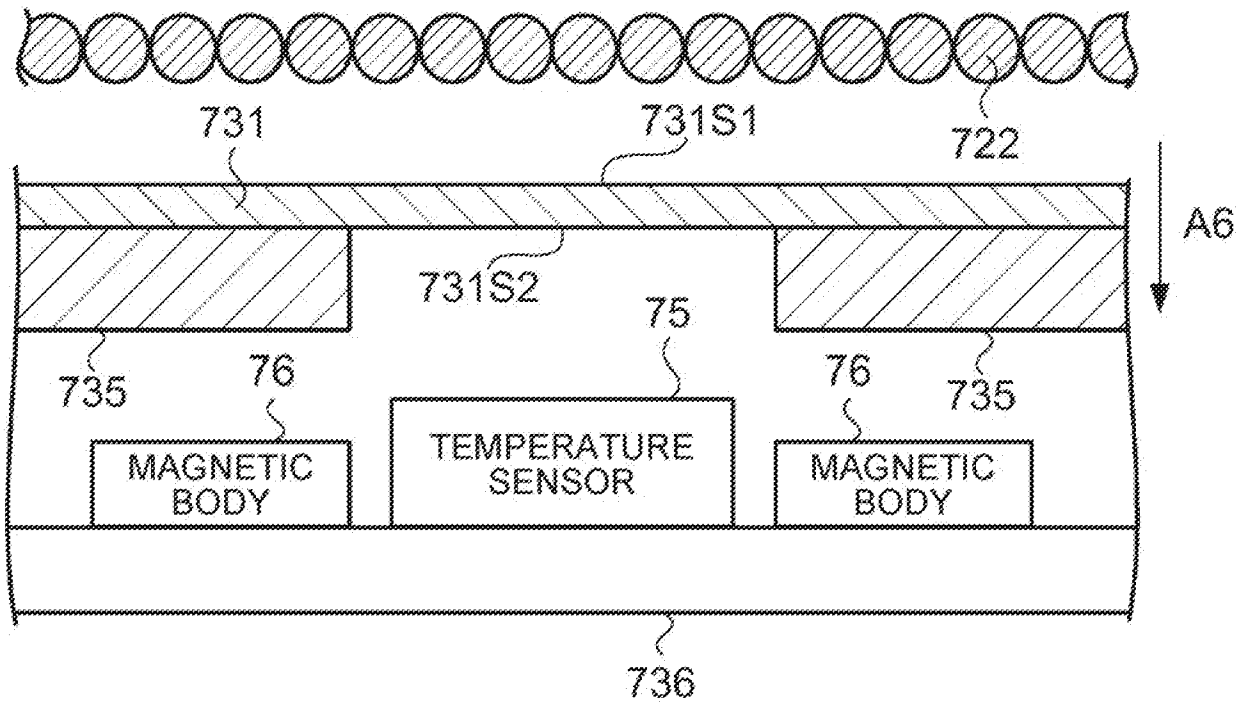
FIG. 5 is a view illustrating the periphery of a temperature sensor in an enlarged scale.

FIG. 5 illustrates the periphery of the temperature sensor 75 in FIG. 4 in an enlarged scale. In the following drawings, the excitation coil 722, the fixing belt 731, the heat generation control member 735, and the support member 736, which draw an arc, are illustrated straightly in order to easily view the drawings. In FIG. 5, the two magnetic bodies 76 are disposed close to the left and right sides of the temperature sensor 75, but both of the magnetic bodies 76 are not in contact with the temperature sensor 75.

Figures 6A, 6B, 6C, 6D:
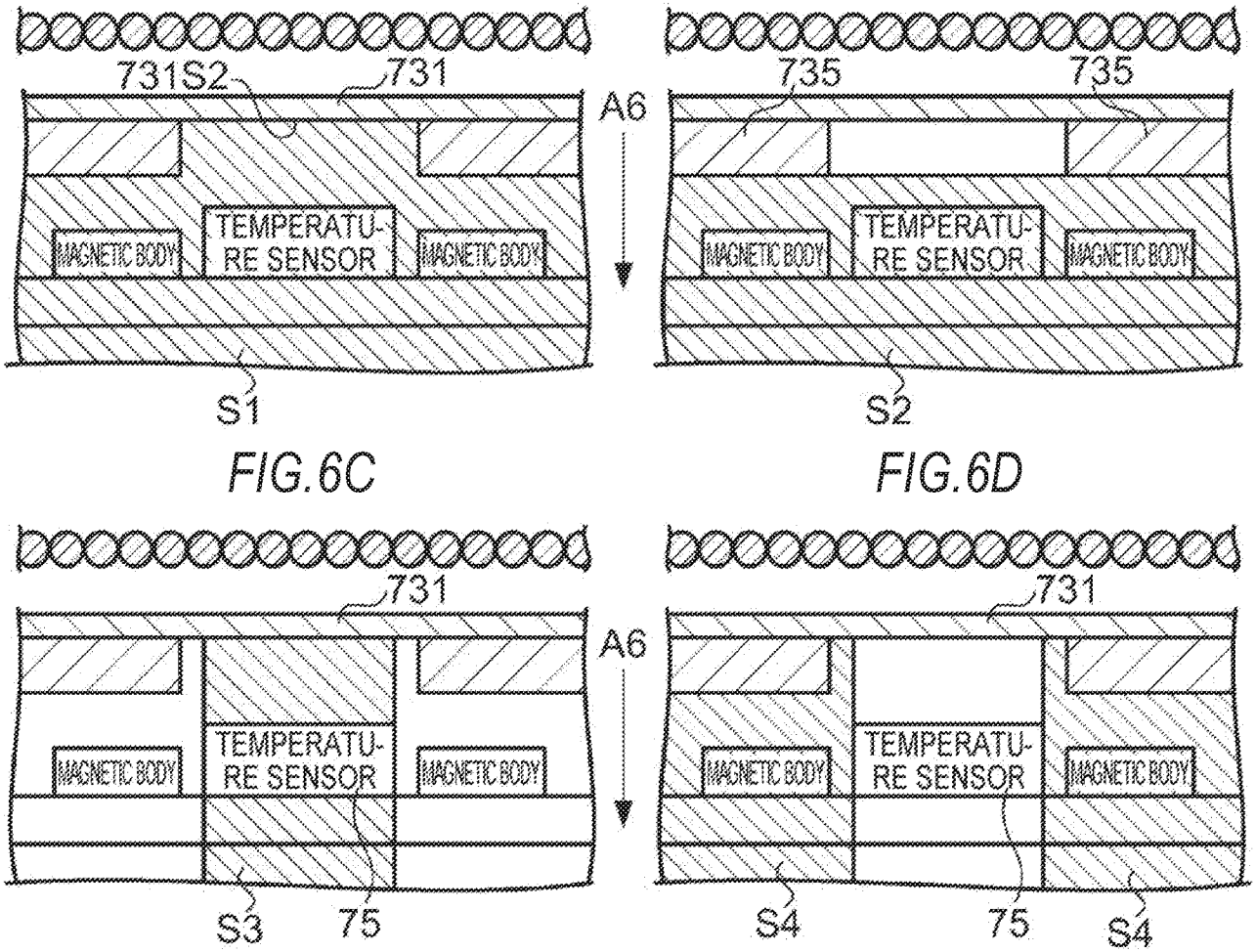
FIGS. 6A to 6D are views illustrating a space around the temperature sensor.

FIGS. 6A to 6D illustrate a space around the temperature sensor 75 illustrated in FIG. 5. In FIG. 6A, a second surface side space S1, which is present on the second surface 731S2 side of the fixing belt 731, is represented. In FIG. 6B, a space S2 of the second surface side space S1, which is spaced farther away from the fixing belt 731 than the heat generation control member 735, is represented. In the present exemplary embodiment, the temperature sensor 75 is disposed in the space S2.

In FIG. 6C, a space S3, which is present in the thickness direction A6 of the fixing belt 731 when viewed from the temperature sensor 75, is represented. In FIG. 6D, a space S4, which is obtained by excluding the space S3 from the second surface side space S1, is represented. The space S4 is one example of a "third space" of the present invention. In the present exemplary embodiment, the magnetic bodies 76 are disposed in the space in which the above-described space S2 and the space S4 overlap with each other.

Figure 7:
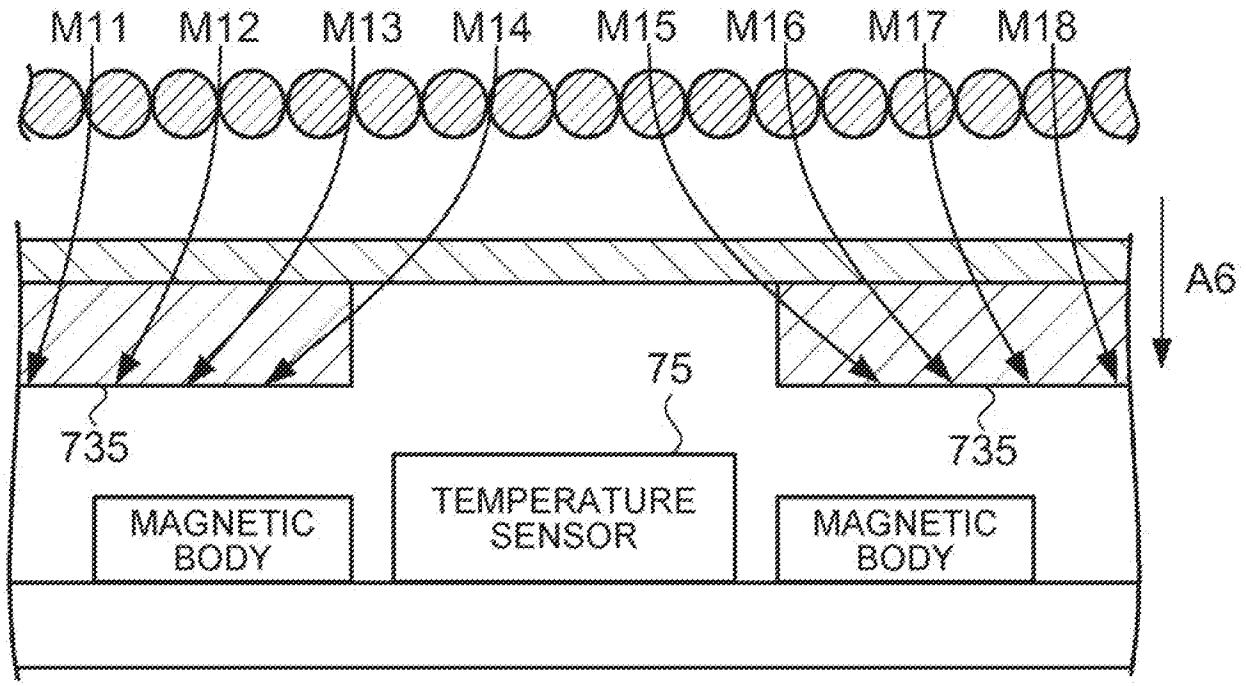
FIG. 7 is a view illustrating exemplary magnetic force lines in a magnetic field generated around the temperature sensor.

FIG. 7 illustrates exemplary magnetic force lines in a magnetic field generated around the temperature sensor 75. In FIG. 7, eight magnetic force lines, which include magnetic force lines M11 to M18 in a magnetic field generated by the IH heater 72, are represented. In the example in FIG. 7, the temperature-sensitive magnetic material of the heat generation control member 735 does not reach the Curie temperature, and is in the state of exhibiting ferromagnetism. In this state, the magnetic force lines M11 to M14 are attracted by a portion of the heat generation control member 735 that is located on the left side of the temperature sensor 75.

In addition, the magnetic force lines M15 to M18 are attracted by a portion of the heat generation control member 735 that is located on the right side of the temperature sensor 75. In this way, in the state where the temperature-sensitive magnetic material of the heat generation control member 735 exhibits ferromagnetism, the temperature-sensitive magnetic material attracts magnetic force lines such that the number of magnetic force lines crossing the temperature sensor 75 is reduced and the temperature increase of the temperature sensor 75 is suppressed, compared to the case where the heat generation control member 735 is not provided.

Figure 8:
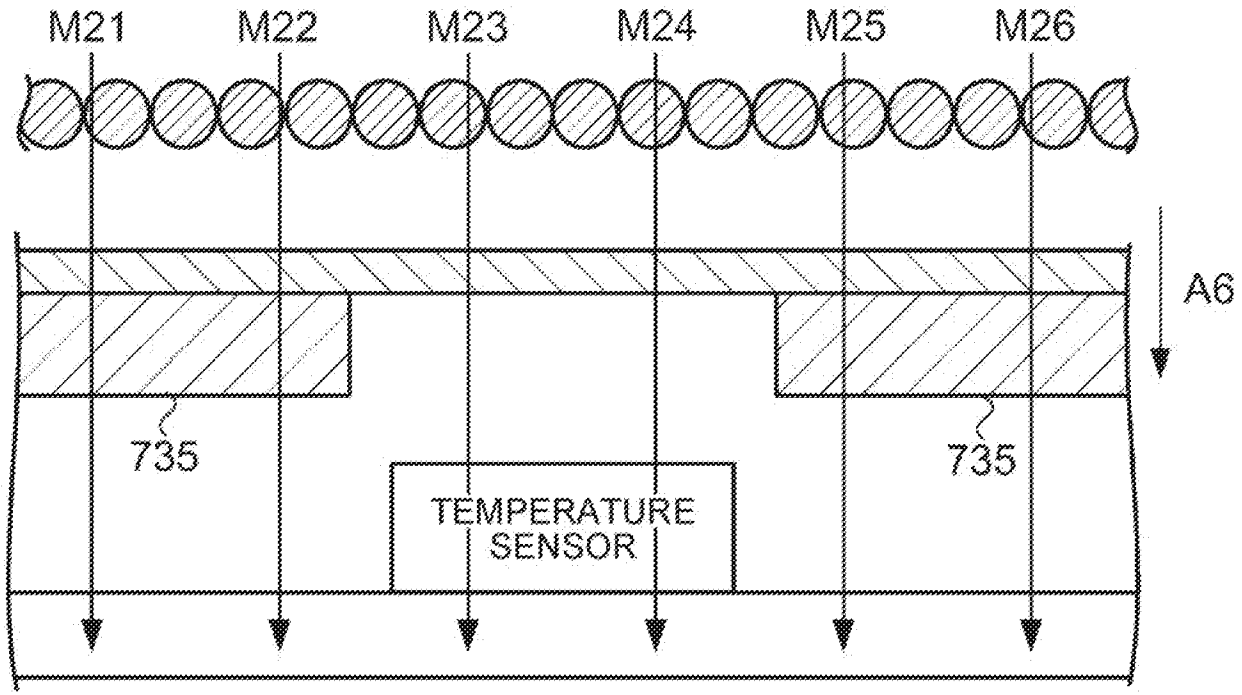
FIG. 8 is a view illustrating exemplary magnetic force lines in the case where a temperature-sensitive magnetic material has reached the Curie temperature.
Figure 9:
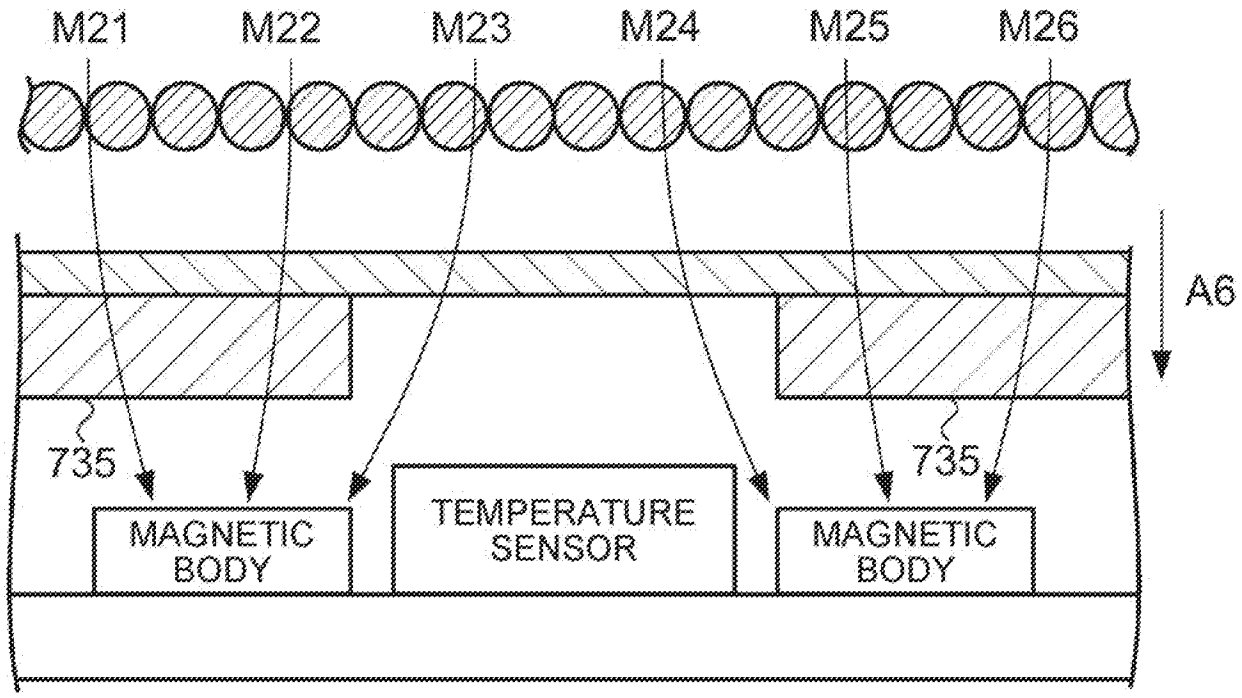
FIG. 9 is a view illustrating exemplary magnetic force lines in the case where a temperature-sensitive magnetic material has reached the Curie temperature.

FIGS. 8 and 9 illustrate exemplary magnetic force lines in the case where the temperature-sensitive magnetic material reaches the Curie temperature. When the temperature-sensitive magnetic material reaches the Curie temperature, the temperature-sensitive magnetic material exhibits paramagnetism, and the magnetic field is weakened compared to the state where the temperature-sensitive magnetic material exhibits ferromagnetism. Therefore, FIGS. 8 and 9 illustrate examples in which a magnetic field is weakened via provision of six magnetic force lines M21 to M26. In addition, the example in FIG. 8 illustrates magnetic force lines in the case where the magnetic bodies 76 are not provided, and the example in FIG. 9 illustrates magnetic force lines in the case where the magnetic bodies 76 are provided (in the present exemplary embodiment) in order to compare variations in magnetic force lines caused by providing the magnetic bodies 76.

In the state illustrated in FIG. 8, because there is no object, which attracts magnetic force lines, around the temperature sensor 75, all the magnetic force lines M21 to M26 extend in the thickness direction A6 of the fixing belt 731. Next, the example in FIG. 9 will be described. The magnetic bodies 76 are magnetic bodies having a higher Curie temperature than the temperature-sensitive magnetic material of the heat generation control member 735. That is, although the magnetic bodies 76 are made of a temperature-sensitive magnetic material, the magnetic bodies 76 exhibit ferromagnetism at the Curie temperature of the temperature-sensitive magnetic material of the heat generation control member 735, i.e. in the state illustrated in FIG. 9.

In the example in FIG. 9, the temperature-sensitive magnetic material exhibits paramagnetism. However, because the magnetic bodies 76, which exhibit ferromagnetism, are present, the magnetic force lines M21 to M23 are attracted by the magnetic body 76, which is located on the left side of the temperature sensor 75, and the magnetic force lines M24 to M26 are attracted by the magnetic body 76, which is located on the right side of the temperature sensor 75.

Thus, in the state where the temperature-sensitive magnetic material of the heat generation control member 735 exhibits paramagnetism, the magnetic bodies 76 attract the magnetic force lines instead of the temperature-sensitive magnetic material such that the number of magnetic force lines crossing the temperature sensor 75 is reduced and the temperature increase of the temperature sensor 75 is suppressed, compared to the case where the magnetic bodies 76 are not provided. Test results confirming the above description are illustrated in FIGS. 10 and 11.

Figure 10:
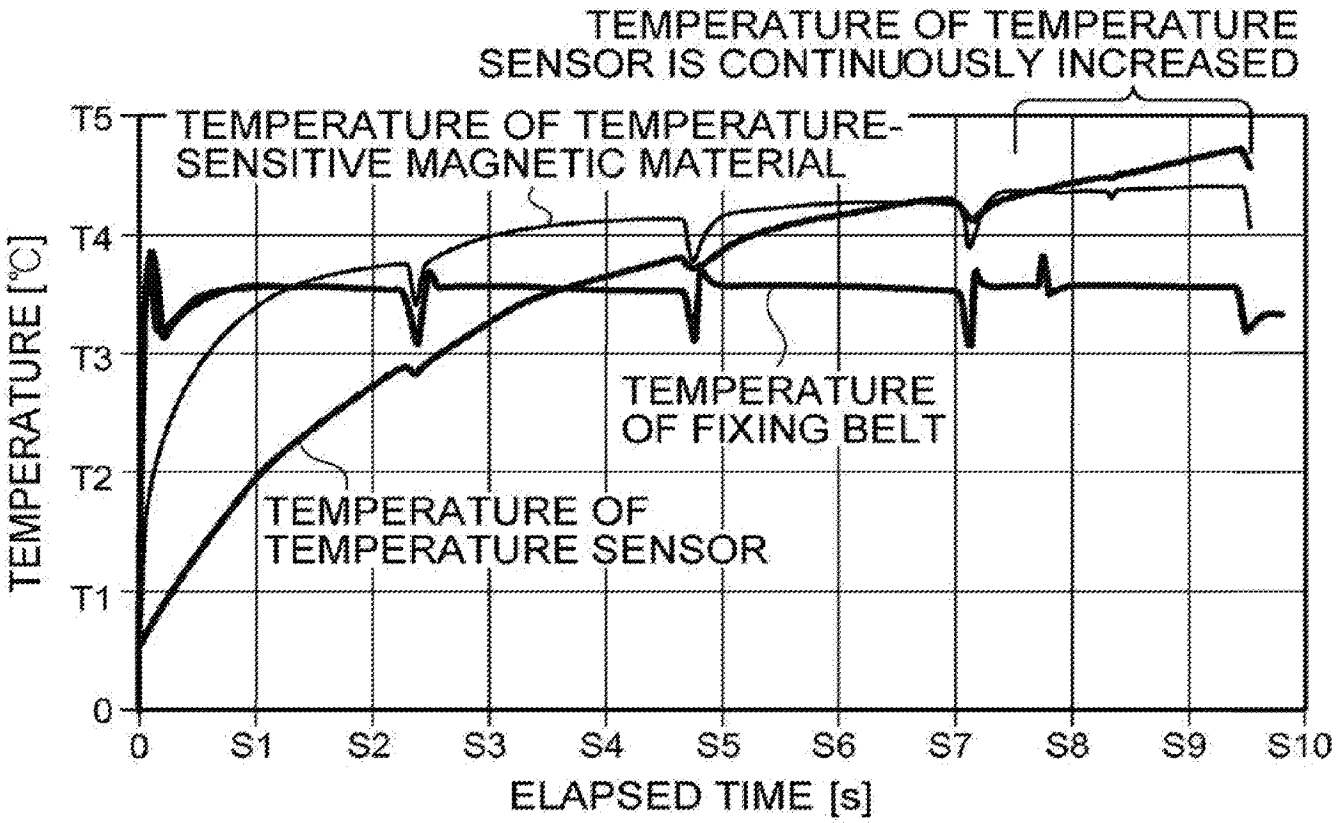
FIG. 10 is a view illustrating an exemplary temperature increase test result of the temperature sensor.
Figure 11:
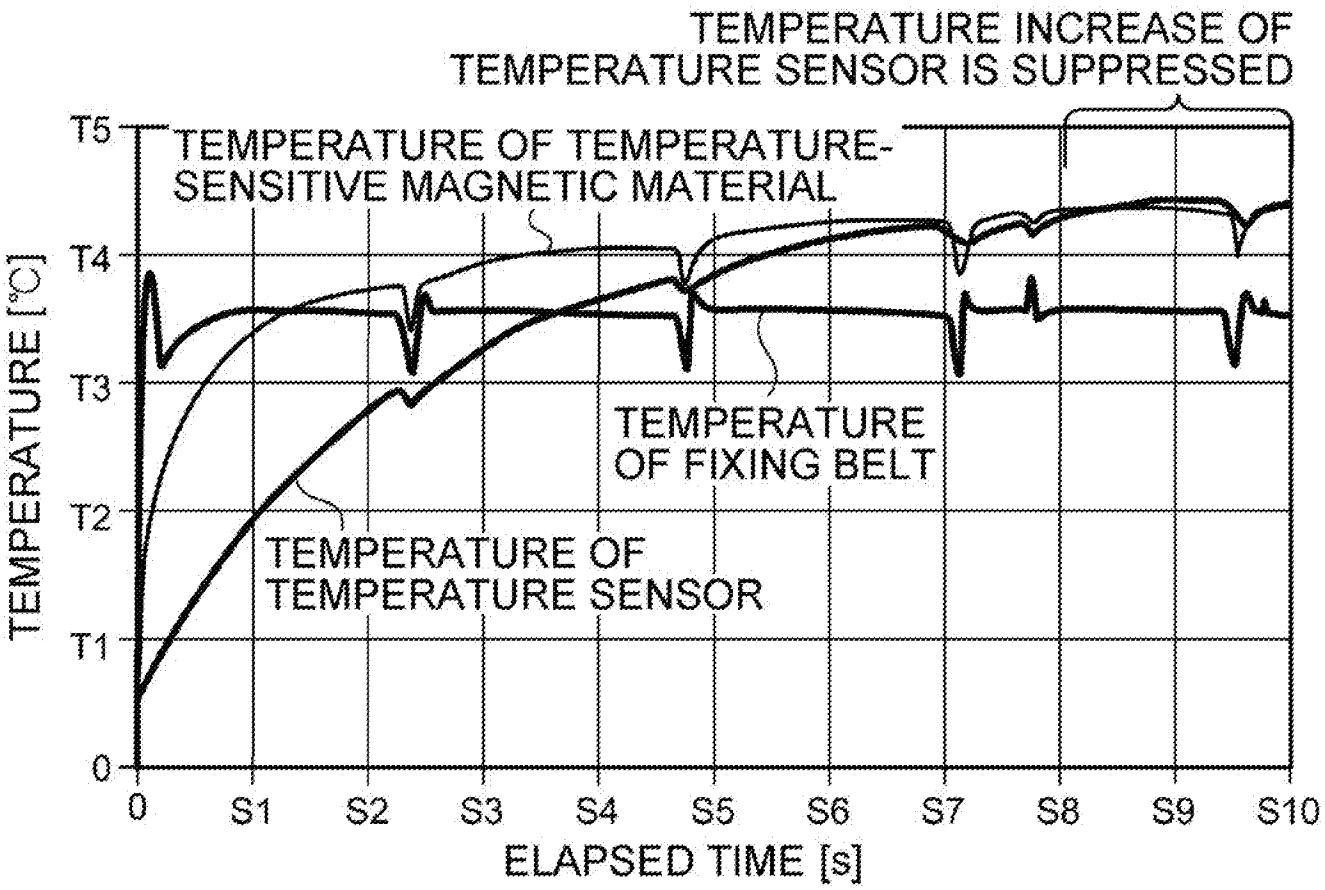
FIG. 11 is a view illustrating an exemplary temperature increase test result of the temperature sensor.

FIGS. 10 and 11 illustrate exemplary temperature increase test results of the temperature sensor 75. In FIGS. 10 and 11, the temperature of the fixing belt 731, the temperature of the temperature-sensitive magnetic material, and the temperature of the temperature sensor 75 are represented in the graphs in which the vertical axis represents the temperature (here, the unit is ° C., and T1 to T5 represent equidistant temperatures) and the horizontal axis represents the elapsed time (here, the unit is second (s), and S1 to S10 represent equidistant times). The example in FIG. 10 represents the temperature in the case where the magnetic bodies 76 are not provided, and the example in FIG. 11 represents the temperature in the case where the magnetic bodies 76 are provided (in the present exemplary embodiment).

In the example in FIG. 10, it is assumed that the temperature of the temperature-sensitive magnetic material has reached the Curie temperature (a temperature higher than T4 (° C.) and lower than T5 (° C.)) at the elapsed time near the midway between S7 (s) and S8 (s). In the example in FIG. 10, after the elapsed time, i.e. in the state where the temperature-sensitive magnetic material exhibits paramagnetism, the temperature of the temperature sensor 75 is continuously increasing beyond the temperature of the temperature-sensitive magnetic material. Meanwhile, in the example in FIG. 11, it is assumed that the temperature of the temperature-sensitive magnetic material has reached the Curie temperature at the elapsed time exceeding S8 (s). In the example in FIG. 11, after the elapsed time, i.e. even in the state where the temperature-sensitive magnetic material exhibits paramagnetism, the temperature increase of the temperature sensor 75 is suppressed, compared to the example in FIG. 10.

Thus, according to the present exemplary embodiment, in a fixing device in which the excessive heating of a belt is suppressed by a temperature-sensitive magnetic body like the fixing device 7, when the temperature-sensitive magnetic body becomes paramagnetism, a sensor that measures the temperature of a fixing belt (the temperature sensor 75) is suppressed from being heated by the action of a magnetic field.

[2] Modified Example

The above-described exemplary embodiment is merely an example of implementing the present invention, and may be modified as follows. In addition, the exemplary embodiment and respective modified examples may be implemented in combination with each other as needed.

[2-1] Heat Generation Control Member

The shape and arrangement of the heat generation control member are not limited to those described above.

Figure 12:
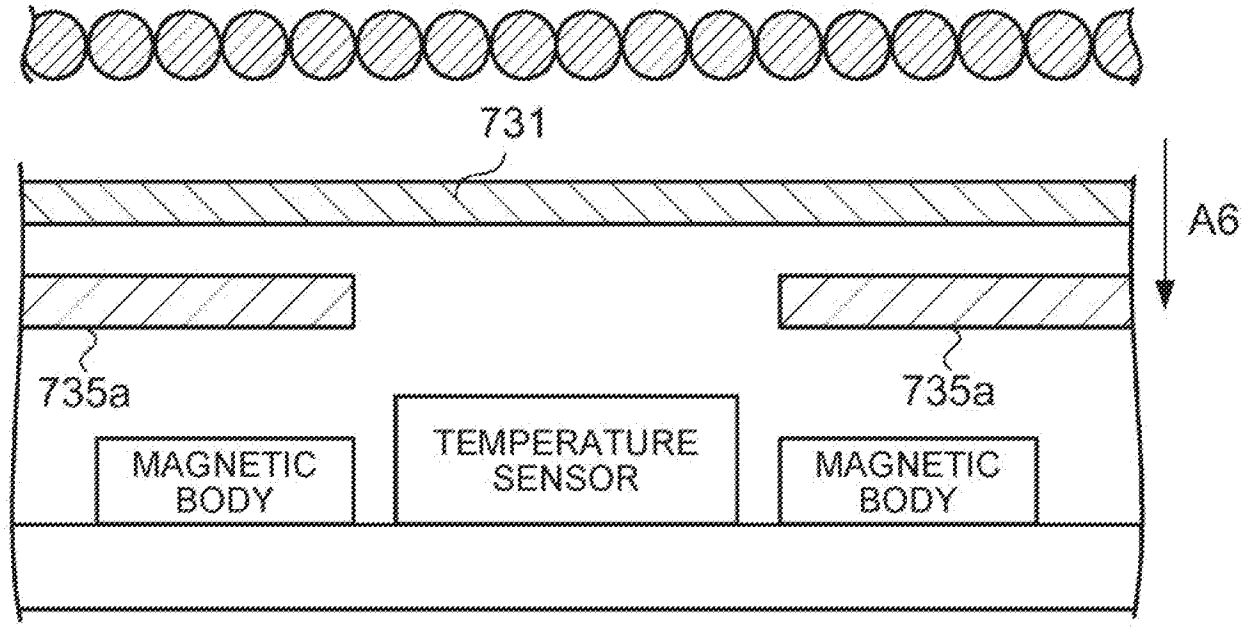
FIG. 12 is a view illustrating an exemplary heating control member according to a modified example.

FIG. 12 illustrates an exemplary heat generation control member according to the present modified example. In the example in FIG. 12, a heat generation control member 735*a*, which is spaced apart from the fixing belt 731 not to come in contact with the fixing belt 731, is illustrated. In this case, the thermal energy of the fixing belt 731 hardly moves to the heat generation control member 735*a*, compared to the case where both members come into contact with each other as in the exemplary embodiment.

Figure 13A:
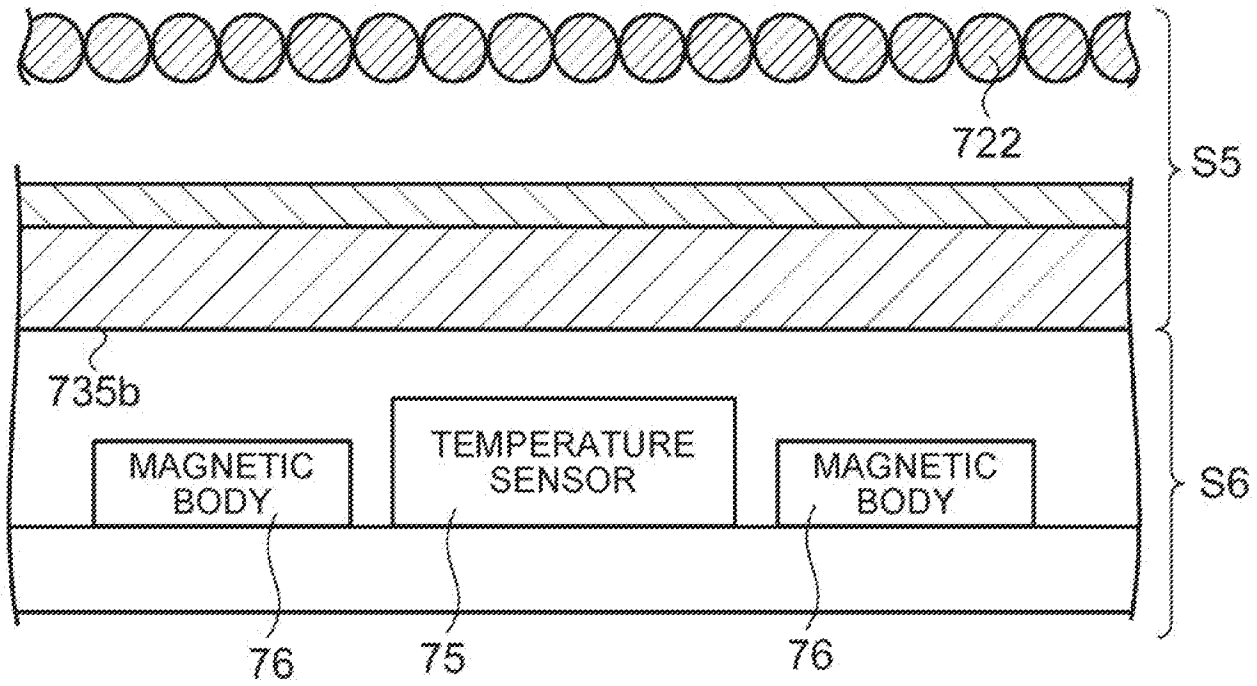
FIGS. 13A and 13B are views illustrating another exemplary heat generation control member according to the alternative modified example.
Figure 13B:
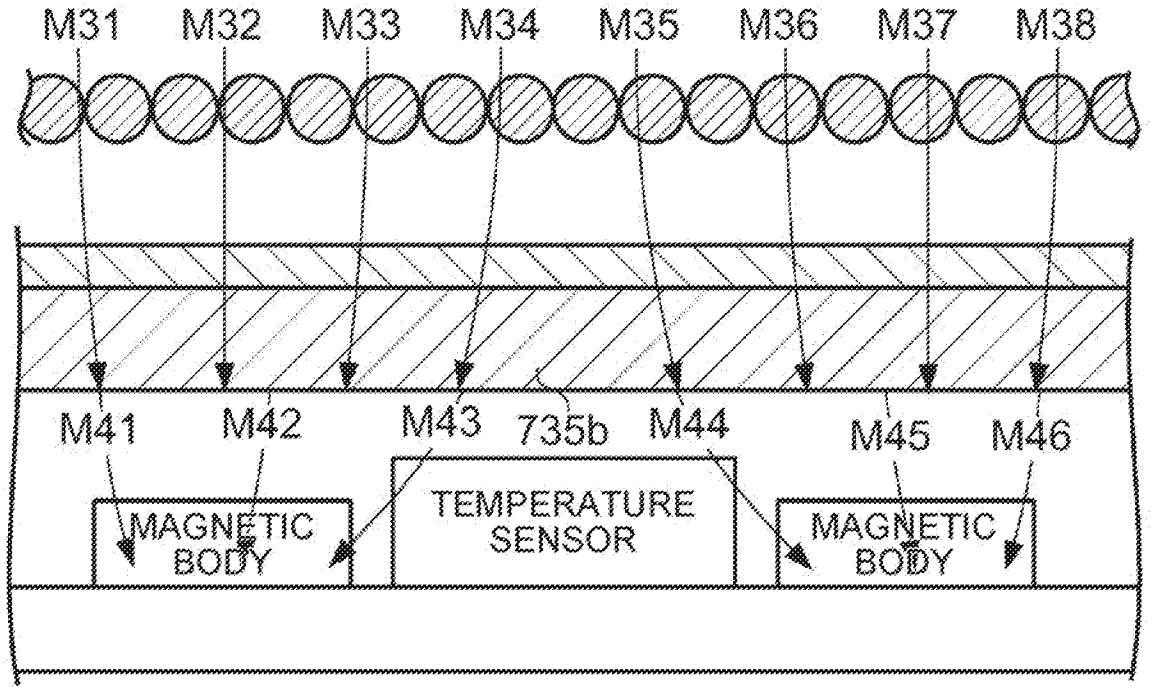

FIGS. 13A and 13B illustrate another exemplary heat generation control member of the present modified example. In FIG. 13A, a heat generation control member 735*b*, which has no hole formed on the fixing belt 731 side facing the temperature sensor 75, is represented. Because no hole is formed in the heat generation control member 735*b*, the temperature sensor 75 is disposed at the position where the fixing belt 731 side is covered with the heat generation control member 735*b*. In this case, because heat generated by the fixing belt 731 is blocked by the heat generation control member 735*b*, the heat of the fixing belt 731 is hardly transferred to the temperature sensor 75, compared to the case where the fixing belt 731 side facing the temperature sensor 75 is not covered.

In this case, in the state where the temperature-sensitive magnetic material of the heat generation control member 735*b* exhibits ferromagnetism, a magnetic field in a space S6, which is closer to the temperature sensor 75 side than the heat generation control member 735*b*, is weakened, compared to a magnetic field in a space S5 on the excitation coil 722 side including the heat generation control member 735*b*. In FIG. 13B, as magnetic lines in this state, eight magnetic force lines M31 to M38 are represented in the space S5, and six magnetic force lines M41 to M46 are represented in the space S6.

Because the magnetic field is weakened and each magnetic force line is attracted by the magnetic body 76 in the space S6 in which the temperature sensor 75 is provided as described above, the number of magnetic force lines penetrating the temperature sensor 75 is reduced and the temperature increase of the temperature sensor 75 is suppressed. In addition, when the temperature-sensitive magnetic material is in the state where the temperature-sensitive material exhibits paramagnetism, a magnetic field is generated as in the example in FIG. 9, and the temperature increase of the temperature sensor 75 is suppressed as in the exemplary embodiment.

In addition, in the example in FIGS. 13A and 13B, the temperature sensor 75 measures the temperature of the heat generation control member 735*b* as an object that is present on the fixing belt 731 side. Even in this case, because the temperature of the heat generation control member 735*b* is increased to the temperature that is close to or higher than the temperature of the fixing belt 731 when the temperature is increased to the extent by which deformation or melting occurs in the fixing belt 731, the controller 110 determines, based on the temperature of the heat generation control member 735*b* measured by the temperature sensor 75, that the temperature of the fixing belt 731 is excessively increased, and thus performs a control to stop heating by the IH heater 72.

[2-2] Second Magnetic Body

A magnetic body, which is provided in order to suppress the temperature increase of the temperature sensor 75 (a "second magnetic body" of the present invention) (hereinafter, a magnetic body simply referred to as a "magnetic body" refer to the "second magnetic body"), is made of a temperature-sensitive magnetic material in each of the above examples.

However, the magnetic may not be made of a temperature-sensitive magnetic material. Even in this case, a material, which exhibits ferromagnetism at the Curie temperature of the temperature-sensitive magnetic material of the heat generation control member, may be used as the magnetic body. However, the second magnetic body may not exhibit ferromagnetism at the Curie temperature of the temperature-sensitive magnetic material. For example, because a material, which exhibits paramagnetism, also becomes a magnetic state when a magnetic field is generated therearound, the material attracts magnetic force lines even if the material does not exhibit ferromagnetism, and as a result, the temperature increase of the temperature sensor 75 is suppressed.

In addition, the number, shape, and arrangement of magnetic bodies are not limited to those described above. For example, although two magnetic bodies are provided in the exemplary embodiment, any one of the magnetic bodies may only be provided. Even in this case, the number of magnetic force lines penetrating the temperature sensor 75 is reduced and at least a temperature increase is suppressed, compared to the case where no magnetic body is provided. In addition, three or more magnetic bodies may be provided, or only one magnetic body having a ring shape to surround the temperature sensor 75 may be provided. Even in these cases, the temperature increase of the temperature sensor 75 is suppressed because magnetic force lines, which will penetrate the temperature sensor 75 if there is no magnetic body, are attracted by the magnetic body.

Figure 14:
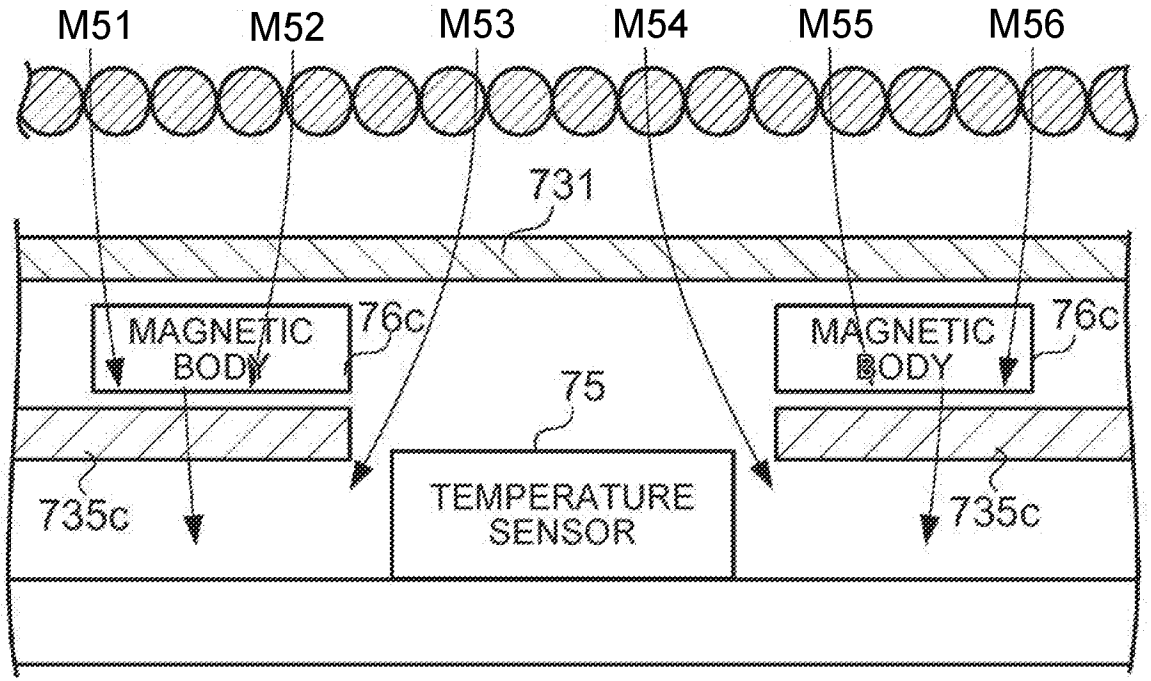
FIG. 14 is a view illustrating an exemplary magnetic body according to the modified example.

FIG. 14 illustrates one exemplary magnetic body according to the present modified example. As in the example in FIG. 12, in FIG. 14, a heat generation control member 735*c*, which is spaced apart from the fixing belt 731, is represented, and magnetic bodies 76*c*, which are disposed in a space between the heat generation control member 735*c* and the fixing belt 731, are represented. In other words, because the magnetic bodies 76*c* attract magnetic force lines M51-M56 heading toward the temperature sensor 75, the temperature increase of the temperature sensor 75 is suppressed. In addition, in the case where the heat generation control member is spaced apart from the fixing belt 731 as in the example in FIG. 14, the temperature sensor 75 may more protrude toward the fixing belt 731 side than the heat generation control member 735*c*.

In the exemplary embodiment, the magnetic bodies 76 are disposed in the space S2 illustrated in FIGS. 6A to 6D, i.e. the space, which is spaced farther away from the fixing belt 731 than the heat generation control member 735. When the magnetic bodies are disposed closer to the fixing belt 731 side than the heat generation control member 735*c* as in the example in FIG. 14, magnetic fluxes are increased and the temperature of the fixing belt 731 becomes uneven, compared to the space in the case where the temperature-sensitive magnetic material of the heat generation control member 735*c* exhibits paramagnetism. When the magnetic bodies 76 are disposed in the space S2 as in the exemplary embodiment, the occurrence of temperature unevenness of the fixing belt 731 is prevented.

Figure 15:
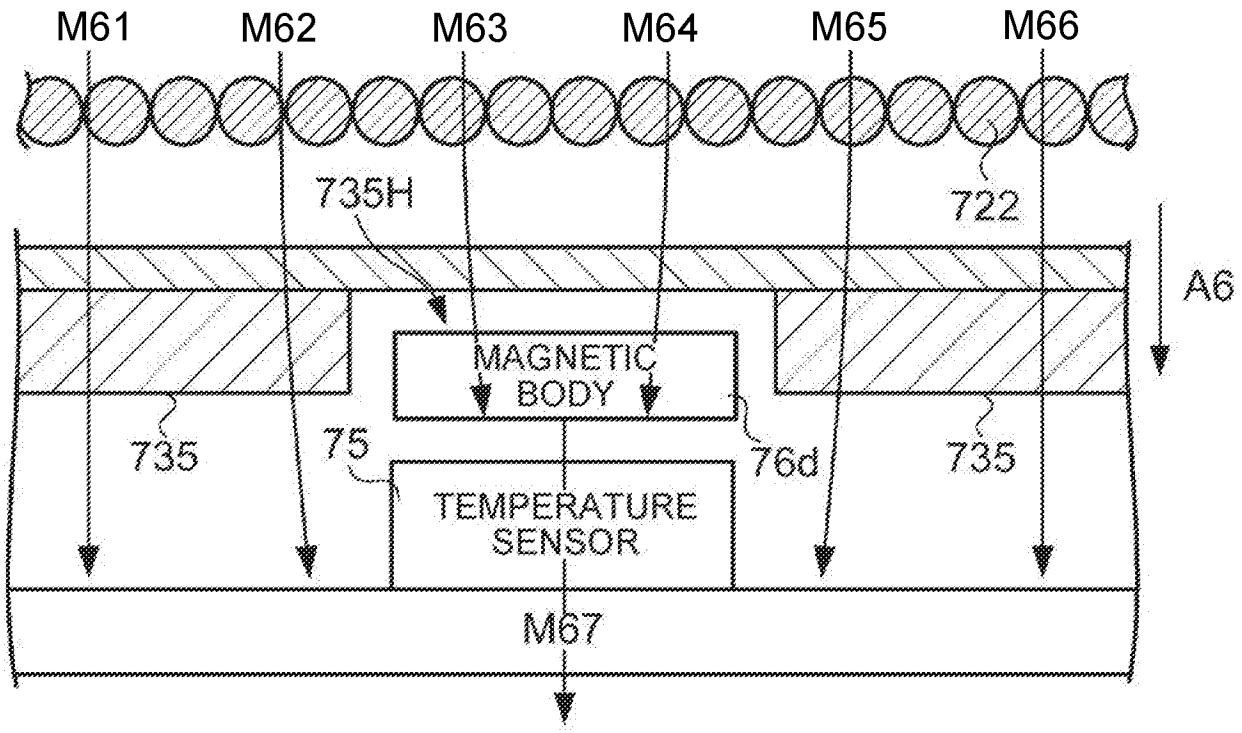
FIG. 15 is a view illustrating another exemplary magnetic body according to the modified example.

FIG. 15 illustrates another exemplary magnetic body according to the present modified example. In FIG. 15, magnetic force lines M61-M66 are shown. In FIG. 15, a magnetic body 76*d*, which is disposed in the hole 735H formed in the heat generation control member 735, is represented. The arrangement of the magnetic body 76*d* will be described below in more detail with reference to FIG. 16

Figure 16:
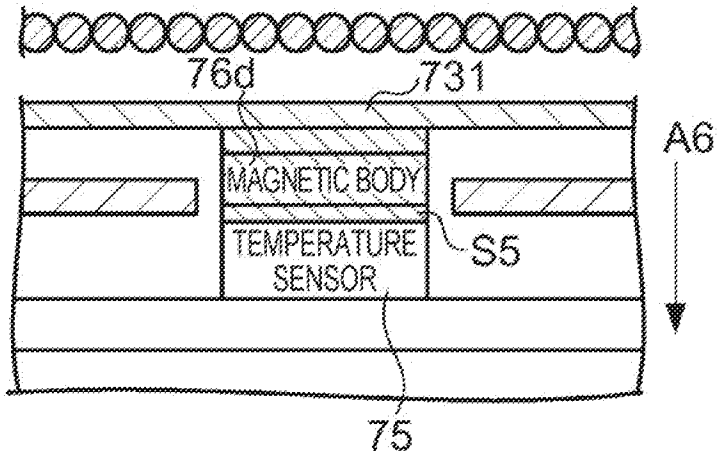
FIG. 16 is a view illustrating a space around the temperature sensor according to the modified example.

FIG. 16 illustrates a space around the temperature sensor 75 of the present modified example. In FIG. 16, the space S5, which is closer to the fixing belt 731 side than the temperature sensor 75 and is present in the thickness direction A6 of the fixing belt 731 when viewed from the temperature sensor 75, is represented. The magnetic body 76*d* is disposed in the space S5. The space S5 is an example of a "fourth space" of the present invention.

A magnetic field in a space, which is closer to the temperature sensor 75 side than the magnetic body 76*d*, is weakened, compared to a magnetic field in the space, which is closer to the excitation coil 722 side than the magnetic body 76*d*, as in the example in FIGS. 13A and 13B. In FIG. 15, as magnetic force lines in these states, two magnetic force lines M63 and M64 are illustrated in the former space, and one magnetic force line M67 is illustrated in the latter space. Even by the magnetic body 76*d*, the number of magnetic force lines penetrating the temperature sensor 75 is reduced and the temperature increase of the temperature sensor 75 is suppressed, compared to the case where the magnetic body 76*d* is not provided. In addition, because heat generated by the fixing belt 731 is blocked by the magnetic body 76*d*, heat of the fixing belt 731 is hardly transferred to the temperature sensor 75, compared to the case where the magnetic body 76*d* is not disposed in the space S5.

In addition, in the exemplary embodiment, the magnetic body 76 is illustrated in the space S4 of the second surface side space S1 illustrated in FIGS. 6A to 6D excluding the space S3, which is present in the thickness direction A6 of the fixing belt 731 when viewed from the temperature sensor 75. When the magnetic body 76*d* is disposed closer to the fixing belt 731 side than the heat generation control member 735*c* in the space S3 as in the example in FIG. 15, a magnetic field of the magnetic body 76*d* on the temperature sensor 75 side becomes strong as the magnetic body 76*d* attracts magnetic force lines with stronger magnetic force. On the other hand, when the magnetic body 76 is disposed in the space S4 as in the exemplary embodiment, the number of magnetic force lines penetrating the temperature sensor 75 is reduced and the temperature increase of the temperature sensor 75 is suppressed as the magnetic force of the magnetic body 76 is increased.

The arrangement of the magnetic bodies described in the above exemplary embodiment and the modified examples will be described below with reference to FIGS. 17A to 17D.

Figure 17A:
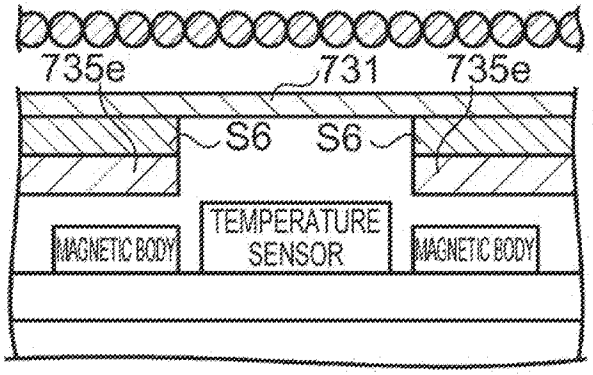
FIGS. 17A to 17D are views illustrating a space around the temperature sensor.

FIGS. 17A to 17D illustrate a space around the temperature sensor 75. In FIGS. 17A to 17D, a heat generation control member 735*e*, which is spaced apart from the fixing belt 731 and has a hole formed therein, is illustrated. In FIG. 17A, spaces S6, which are closer to the fixing belt 731 side than a temperature-sensitive magnetic material of the heat generation control member 735*e* and are present in the thickness direction A6 of the fixing belt 731 when viewed from the temperature-sensitive magnetic material, are illustrated.

Figure 17B:
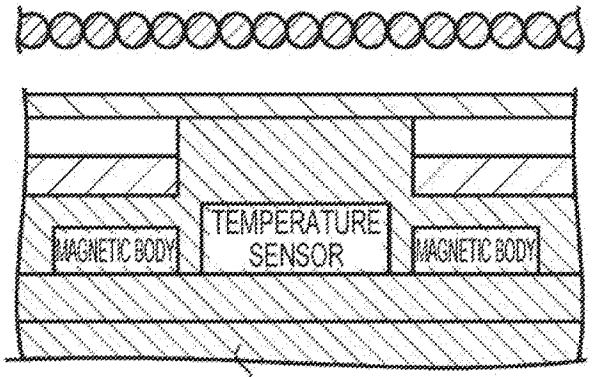

In FIG. 17B, a space S7, which is obtained by excluding the spaces S6 from the second surface side space S1 (the space present on the second surface 731S2 side of the fixing belt 731) illustrated in FIG. 6A, is illustrated. In any example, the temperature sensor 75 is disposed in the space S7. In addition, in the present invention, the temperature sensor 75 may be disposed in the space S7. The space S7 is an example of a "first space" of the present invention.

Figure 17C:
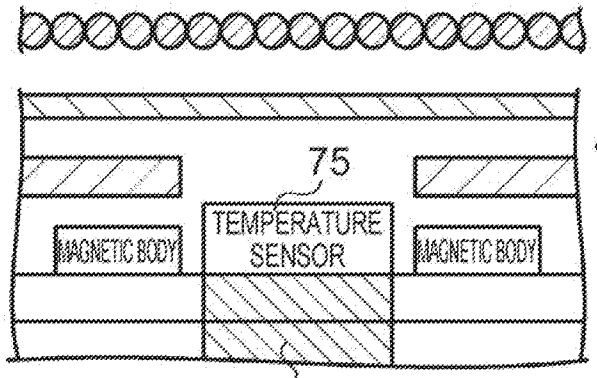
Figure 17D:
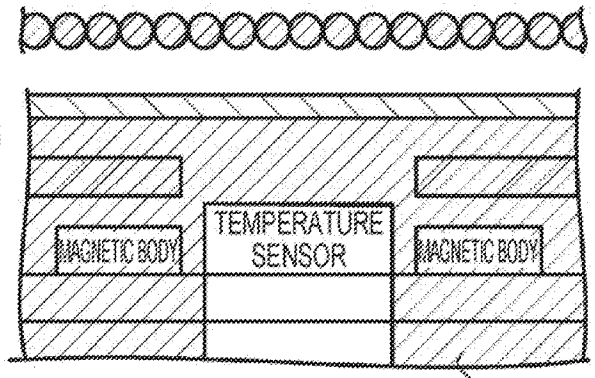

In addition, in FIG. 17C, a space S8, which is more opposite to the fixing belt 731 than the temperature sensor 75 and is present in the thickness direction A6 when viewed from the temperature sensor 75, is illustrated. In FIG. 17D, a space S9, which is acquired by excluding the space S8 from the second surface side space S1, is illustrated. In the both examples, a magnetic body is disposed in the space S9. In addition, in the present invention, a magnetic body may be disposed in the space S9. The space S9 is an example of the "second space" of the present invention.

When the temperature sensor 75 is disposed in the space S7 and the magnetic body is disposed in the space S9, even in the state where the temperature-sensitive magnetic material exhibits paramagnetism, the number of magnetic force lines penetrating the temperature sensor 75 is reduced and the temperature increase of the temperature sensor 75 is suppressed, compared to the case where the magnetic body is not provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt configured to generate heat in response to a magnetic field to fix an image to a medium by the heat;

a magnetic field generating unit that is disposed on a first surface side of the belt to generate the magnetic field that heats the belt;

a heat generation control member that includes a first magnetic body that is disposed in a space on a second surface side of the belt and is configured to change from ferromagnetism to paramagnetism at a Curie temperature, the heat generation control member being configured to suppress heat generation of the belt;

a sensor that is disposed in a first space, which is obtained by excluding a space, which is closer to the belt with respect to the first magnetic body and is present in a thickness direction of the belt when viewed from the first magnetic body, from the space on the second surface side, the sensor being configured to measure a temperature of an object that is present on the belt side and heated by an action of the magnetic field; and a second magnetic body that is disposed in a second space, which is obtained by excluding a space, which is opposite to the belt with respect to the sensor and is present in the thickness direction when viewed from the sensor, from the space on the second surface side.

2. The fixing device according to claim 1, wherein the second magnetic body exhibits ferromagnetism at the Curie temperature of the first magnetic body.

3. The fixing device according to claim 2, wherein the second magnetic body has a Curie temperature that is higher than a Curie temperature of the first magnetic body.

4. The fixing device according to claim 3, wherein the second magnetic body is disposed in a space of the second space, which is farther away from the belt than the first magnetic body.

5. The fixing device according to claim 2, wherein the second magnetic body is disposed in a space of the second space, which is farther away from the belt than the first magnetic body.

6. The fixing device according to claim 2, wherein the heat generation control member is provided with a hole formed in the thickness direction, and wherein the sensor is disposed in the thickness direction of the hole.

7. The fixing device according to claim 2, wherein the sensor is disposed at a position where the belt side is covered with the heat generation control member.

8. The fixing device according to claim 2, wherein the second magnetic body is disposed in a third space, which is obtained by excluding a space, which is present in the thickness direction of the belt when viewed from the sensor, from the second space.

9. The fixing device according to claim 2, wherein the second magnetic body is disposed in a space S5 of the second space, which is closer to the belt side than the sensor and is present in the thickness direction when viewed from the sensor.

10. An image forming apparatus comprising:

the fixing device according to claim 2; and an image forming device configured to form the image on the medium so that the image formed on the medium is fixed to the medium by the fixing device.

11. The fixing device according to claim 1, wherein the second magnetic body has a Curie temperature that is higher than a Curie temperature of the first magnetic body.

12. The fixing device according to claim 11, wherein the second magnetic body is disposed in a space of the second space, which is farther away from the belt than the first magnetic body.

13. The fixing device according to claim 1, wherein the second magnetic body is disposed in a space of the second space, which is farther away from the belt than the first magnetic body.

14. The fixing device according to claim 1, wherein the heat generation control member is provided with a hole formed in the thickness direction, and wherein the sensor is disposed in the thickness direction of the hole.

15. The fixing device according to claim 1, wherein the sensor is disposed at a position where the belt side is covered with the heat generation control member.

16. The fixing device according to claim 1, wherein the second magnetic body is disposed in a third space, which is obtained by excluding a space, which is present in the thickness direction of the belt when viewed from the sensor, from the second space.

17. The fixing device according to claim 1, wherein the second magnetic body is disposed in a space S5 of the second space, which is closer to the belt side than the sensor and is present in the thickness direction when viewed from the sensor.

18. An image forming apparatus comprising:

the fixing device according to claim 1; and an image forming device configured to form the image on the medium so that the image formed on the medium is fixed to the medium by the fixing device.

19. The fixing device according to claim 1, wherein the second magnetic body is disposed such that no part of the second magnetic body is located directly below the sensor in the thickness direction, and wherein the belt is located above the sensor in the thickness direction.

* * * * *